US008757738B2

(12) United States Patent
Fiori

(10) Patent No.: US 8,757,738 B2
(45) Date of Patent: Jun. 24, 2014

(54) MECHANISM FOR CLOSING SLIDING DOORS

(75) Inventor: Bruno Fiori, Turate (IT)

(73) Assignee: Unifor S.p.A., Turate (IT)

( * ) Notice: Subject to any disclaimer, the term of this patent is extended or adjusted under 35 U.S.C. 154(b) by 0 days.

(21) Appl. No.: 13/290,561

(22) Filed: Nov. 7, 2011

(65) Prior Publication Data

US 2012/0110919 A1 May 10, 2012

(30) Foreign Application Priority Data

Nov. 8, 2010 (IT) ..... MI10A2069

(51) Int. Cl.

| | |
|---|---|
| ***E06B 3/50*** | (2006.01) |
| ***E05B 65/46*** | (2006.01) |
| ***E05C 9/10*** | (2006.01) |
| ***E05C 3/00*** | (2006.01) |
| ***E05C 9/00*** | (2006.01) |
| ***E05B 65/06*** | (2006.01) |
| ***E05C 17/00*** | (2006.01) |
| ***E05C 19/00*** | (2006.01) |
| ***E05B 55/00*** | (2006.01) |

(52) U.S. Cl.

USPC ..... 312/109; 312/215; 312/217; 49/449; 49/394; 49/395

(58) Field of Classification Search

USPC ..... 312/109, 139.1, 215–218, 222, 349, 312/350; 292/32–34, 37, 42, 44–46, 49, 54, 292/DIG. 68; 49/394, 395, 449

See application file for complete search history.

(56) References Cited

U.S. PATENT DOCUMENTS

| | | | | | |
|---|---|---|---|---|---|
| 692,463 | A | * | 2/1902 | Livingston | 292/230 |
| 1,006,983 | A | * | 10/1911 | Schaffert | 292/53 |
| 1,490,321 | A | * | 4/1924 | Hochreiner | 292/33 |
| 2,118,213 | A | * | 5/1938 | Malott | 312/139.2 |
| 2,196,001 | A | * | 4/1940 | Vanderveld | 70/95 |
| 2,227,803 | A | * | 1/1941 | Bales | 70/264 |
| 2,249,214 | A | * | 7/1941 | Kurtzon | 70/100 |
| 2,448,748 | A | * | 9/1948 | Vanderveld | 70/82 |
| 2,941,832 | A | * | 6/1960 | Grossman | 292/207 |
| 3,318,646 | A | * | 5/1967 | Ibel | 312/218 |
| 4,148,535 | A | * | 4/1979 | Fenwick | 312/304 |
| 4,741,186 | A | * | 5/1988 | Martin | 70/100 |
| 5,458,409 | A | * | 10/1995 | Sheng | 312/216 |

(Continued)

FOREIGN PATENT DOCUMENTS

| | | | |
|---|---|---|---|
| FR | 2 935 731 | A1 | 3/2010 |
| GB | 2 409 233 | A | 6/2005 |
| JP | 8-193448 | A | 7/1996 |

*Primary Examiner* — Janet M Wilkens
*Assistant Examiner* — Andrew Roersma
(74) *Attorney, Agent, or Firm* — Dickstein Shapiro LLP

(57) ABSTRACT

A mechanism for closing sliding doors of furniture. The mechanism includes at least two rotatable closing elements, each associated with a respective door. A locking body is associated with the closing element for rotating and locking the closing element in either an open position or a closed position. The closing element also includes a locking portion that, through the rotation of the closing element, can pass from a first position in which the locking portion prevents the translation of the sliding doors of the furniture, to a second position which allows the translation of the sliding doors. The closing mechanism also includes a synchronization bar that makes the closing elements rotate as a unit, ensuring the simultaneous locking of the sliding doors in the closed or open position.

2 Claims, 9 Drawing Sheets

(56) References Cited

U.S. PATENT DOCUMENTS

| | | | | |
|---|---|---|---|---|
| 5,791,700 | A | 8/1998 | Biro | |
| 6,086,121 | A * | 7/2000 | Buckland | 292/34 |
| 6,131,423 | A * | 10/2000 | Xenaki et al. | 70/158 |
| 6,722,167 | B1 * | 4/2004 | Hsu | 70/78 |
| 7,318,632 | B2 * | 1/2008 | Bidinger et al. | 312/319.9 |
| 2006/0066187 | A1 | 3/2006 | Chang | |
| 2009/0278426 | A1 * | 11/2009 | Vinke | 312/215 |
| 2010/0154490 | A1 * | 6/2010 | Hagemeyer et al. | 70/107 |
| 2011/0316397 | A1 * | 12/2011 | Sabelli | 312/216 |

* cited by examiner

MECHANISM FOR CLOSING SLIDING DOORS

BACKGROUND OF THE INVENTION

1. Field of the Invention

The present invention relates to a closing mechanism for sliding doors of furniture.

2. Description of the Related Art

It is known that in furniture constituted by sliding doors it is possible to determine the locking of the doors for example with hooking systems arranged at the end of the door which cooperate as undercuts with suitable seats arranged on a framework of the furniture.

Japanese patent JP8193448 discloses the use of a closing element for sliding doors that may be positioned so as to determine an undercut pin down with a respective seat obtained on a track in which the door may slide. The movement of such closing element allows determining a condition in which the sliding doors are locked closed and a condition in which the relative sliding of the doors is allowed.

Other known solutions provide for fixing to one of the two sliding doors, for example to a door of a display glass, a rack element suitable for receiving a lock block element. When the block element is positioned on the rack and integrally fixed thereto, the relative translation of the two doors is prevented so as to determine the closing of the display glass.

Such devices are not free from drawbacks.

Actually, as known, the closing operation of the known mechanisms are complex and require to be conducted accurately to avoid ruining the doors especially if made of fragile material, for example glass.

SUMMARY OF THE INVENTION

An object of the present invention is to obtain and provide a mechanism for closing sliding doors capable of at least partly overcoming the drawbacks outlined above with reference to the prior art.

In particular, a task of the present invention is to provide a mechanism for closing sliding doors that can be easily actuated and that can allow simultaneously closing several sliding doors.

Such object and tasks are obtained through a mechanism for closing sliding doors according to the present disclosure.

According to a general embodiment, a mechanism for closing sliding doors of furniture, said furniture comprising sliding doors suitable for sliding along a translation direction, said doors being two or more doors to gain access to at least one space in the furniture, comprises:

at least two closing elements, each associated to a respective door, suitable for being fixedly connected to the furniture and with respect to the latter rotatable about a rotation axis;

a locking body suitable for being fixedly connected to the furniture in which said locking body is associated to the closing element so as to make it rotate by a predetermined amount about its rotation axis from a first to a second angular position and vice-versa and so as to be able to lock it in any one of said positions;

said at least one closing element further comprising a locking portion that, through the rotation of the closing element, may pass from a first position in which such locking portion is suitable for preventing the translation of the sliding doors of the furniture to a second position suitable for allowing the translation of the sliding doors.

Preferably the closing mechanism comprises a synchronization bar that makes said at least two closing elements rotate as a unit so that the rotation through the locking body of any one of said closing elements determines the simultaneous rotation of all the other closing elements connected through the synchronization bar ensuring the simultaneous locking in said first closing position or in said second open position of the sliding doors of the furniture.

According to a further general embodiment, a furniture comprises:

sliding doors suitable for sliding along a translation direction in which such doors are two or more to gain access to at least one space in the furniture;

a closing mechanism which ensures the simultaneous locking in closing position or the possibility of opening the sliding doors of the furniture.

BRIEF DESCRIPTION OF THE DRAWINGS

Further features and advantages of the closing mechanism for sliding doors according to the invention will be apparent from the description outlined hereinafter of preferred embodiments, provided by way of non-limiting example, with reference to the attached drawings, wherein.

DETAILED DESCRIPTION OF THE PREFERRED EMBODIMENTS

Figure 1:
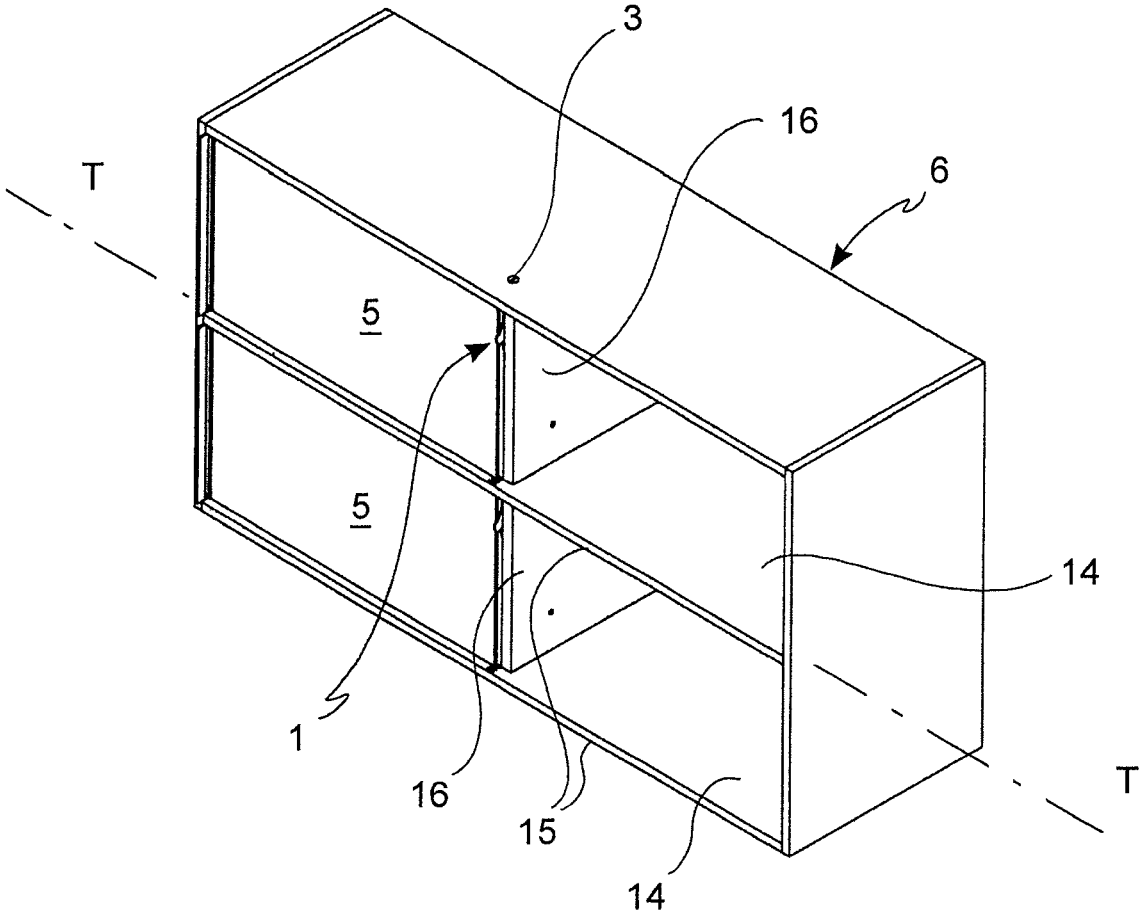
FIG. 1 illustrates a view of a furniture with sliding doors comprising a mechanism for closing according to the invention.

With reference to the aforementioned figures, a mechanism for closing sliding doors according to the invention is indicated in its entirety with 1. The mechanism 1 for closing sliding doors of furniture comprises at least two closing elements 2, a locking body 3 and a synchronization bar 7 which cooperate with each other so as to be suitable for locking—in closing position—the sliding doors 5 of furniture 6 or allow the normal sliding thereof.

According to one embodiment, said at least two closing elements 2 are suitable for being fixedly connected to the furniture 6 and with respect to the latter free to rotate about a rotation axis R-R.

According to one embodiment, each of said at least two closing elements 2 are associated to a respective sliding door 5.

According to one embodiment, the rotation axis R-R is perpendicular to the surface of the furniture 6 on which any one of the closing elements 2 may be fixedly connected.

Figure 3:
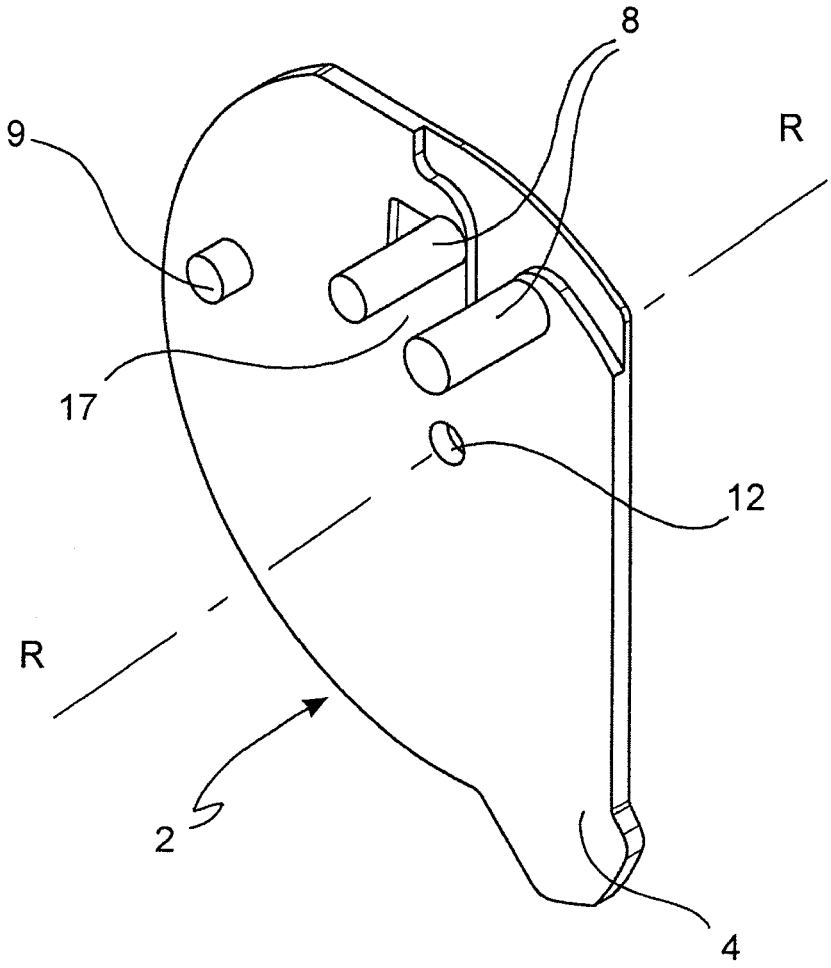
FIG. 3 illustrates an axonometric view of a closing element of the closing mechanism according to the invention.
Figure 4:
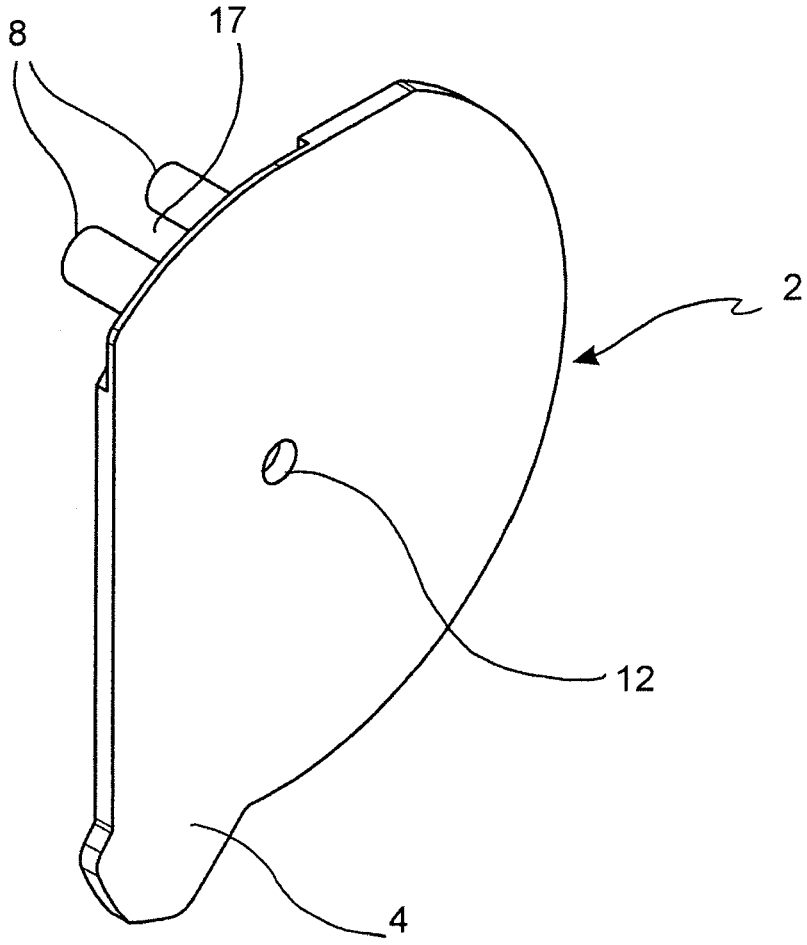
FIG. 4 illustrates a further axonometric view of the closing element of FIG. 3.

According to one embodiment, as observable in FIGS. 3 and 4, said at least two closing elements 2 comprise a disc-shaped body.

According to one embodiment, the axis of the disc-shaped body coincides with the rotation axis R-R.

According to one embodiment, the rotation axis R-R coincides with the axis of a disc-hole 12 of said at least one closing element 2 suitable for receiving a fixing means 13 suitable for fixedly connecting the closing element 2 to the furniture 6. Said at least one closing element 2 is thus fixedly connected to the furniture 6, but with respect to the latter free to rotate about the rotation axis R-R.

According to further embodiments not shown in the figures, the closing element 2 may be variously shaped without jeopardising the operation thereof, for example the shape thereof may be that of rhombus, square, circle, etcetera.

Figure 2:
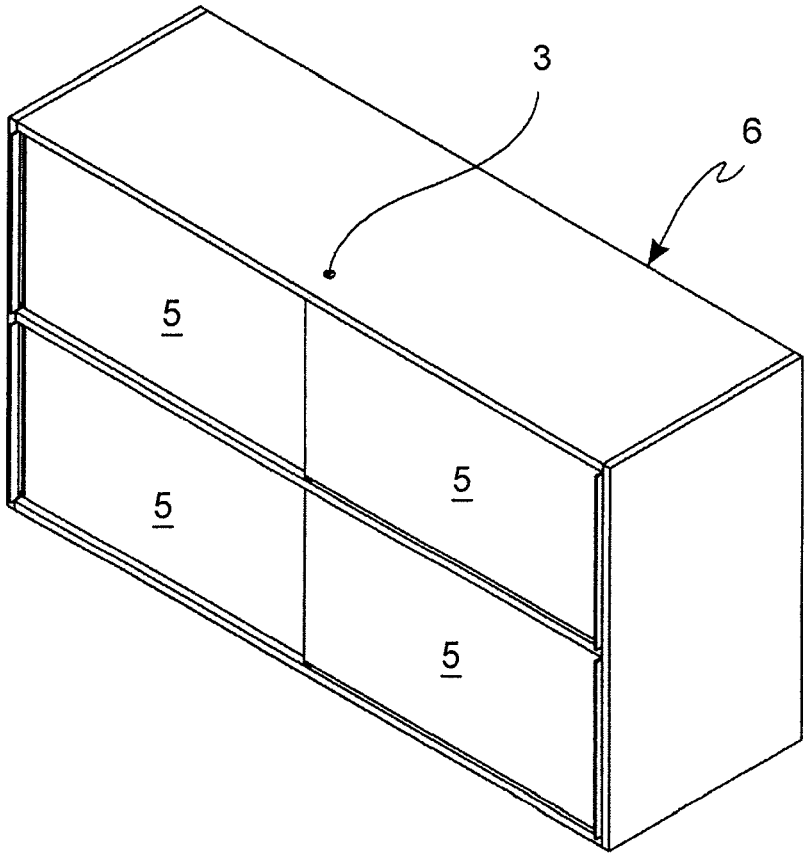
FIG. 2 illustrates the furniture of FIG. 1 with doors in closing position.

Such closing mechanism 1 may be used on furniture generally comprising the use of two or more sliding doors so that a user can fixedly connect—in closing position—the doors so as to prevent access to the spaces of the furniture as configured in FIGS. 1 and 2.

In one embodiment, the furniture 6, on which the closing mechanism 1 is mounted, is made up of at least one space 14 comprising a sliding door on at least one side.

According to one embodiment, such sliding doors are used in pairs of two and each pair is associated to any one of said at least two closing elements 2 so as to allow a door to slide—in opening position—so as to be superimposed to the remaining door and allow access to the space 14 of the furniture 6.

According to one embodiment, the space 14 of the furniture 6 is divided into sub-spaces by a dividing panel 16 that is positioned inside the furniture 6.

In particular, the furniture 6 is constituted by a structure and by a plurality of covering panels so as to form at least one space therein and in which at least one side of such furniture comprises such sliding doors.

It should be observed that the furniture 6 thus constituted is modular or in other words the number of spaces, the number of dividing panels and the number of sliding doors may vary so as to obtain a furniture with the desired features in terms of dimensions and number of spaces protected by the sliding doors.

According to one embodiment, the sliding doors 5 may translate along a direction T-T parallel to the rotation axis R-R of the closing element.

According to one embodiment, said at least two closing elements 2 each comprise pins 8 that project from a surface of such elements so as to be able to mechanically cooperate with the locking body 3 to allow the rotation of said at least two closing elements 2.

According to one embodiment, the pins 8 project from a surface of any one of the closing elements 2 suitable for being faced to the furniture 6 when it is fixedly connected to the latter.

Such pins 8 are positioned on the periphery of the disc-shaped body of the closing element 2 and they are capable of mechanically cooperating with a rotation pin 10 of a locking body 3 so that to a rotation of said rotation pin 10 of the locking body 3 corresponds a rotation of said at least one closing element 2 about the rotation axis R-R so that the closing element rotates angularly by a predetermined amount from a first position to a second.

Preferably according to one embodiment, there are two pins 8 adjacent to each other and delimiting a pin seat 17 that receives the rotation pin 10 of the locking body. Actually, the rotation pin 10 of the locking body 3 ends in abutment with the pins 8 so that during the movement thereof it drags the pins 8 therewith allowing the movement of the closing element 2.

According to one embodiment, said at least two closing elements 2 each comprise a hooking pin 9 that projects from a surface of said closing elements so as to fixedly connect said elements to the synchronization bar 7.

According to one embodiment, such hooking pin 9 projects from a surface of said at least two hooking elements 2 that is suitable for being faced to the furniture 6 when the closing mechanism 1 is installed.

In particular, such hooking pin 9 is arranged along the periphery of the closing elements 2 and it is such to allow transferring the movement of the closing element 2 to the synchronization bar 7 or vice-versa.

Actually, during the rotation of the closing element 2 the hooking pin 9 is received in a hooking hole 11 of the synchronization bar 7 so that the movement of the closing element can be transferred to the synchronization bar 7 or vice-versa.

According to one embodiment, said at least two closing elements 2 each comprise a locking portion 4 that is suitable for locking or allowing the translation of the sliding doors 5 of the furniture 6 relatively to the position assumed by the closing element 2.

According to one embodiment, said at least two closing elements 2 comprising disc-shaped bodies comprise the locking portion 4 that extends from the outer diameter of such disc.

In particular, there can be observed two distinct angular positions of the closing element 1. A first closing position in which the closing element 2 is in a position such that the locking portion 4 prevents the associated sliding doors 5 from moving and a second open position in which the closing element 2 is in a position such that the locking portion 4 allows the associated sliding doors 5 to be able to move ensuring access to the space in the furniture 6.

According to one embodiment, such locking portion 4 is integral with each closing element 2 and when the closing element 2 is rotated through the locking body 3 in closing position, such locking portion 4 is positioned so as to be suitable for interfering with the translation movement along the direction T-T of the sliding doors 5, thus locking them. On the contrary, when the closing element 2 is in open position, the locking portion 4 is suitable to be unconstrained from the sliding doors 5 and thus the latter may be translated along the direction T-T so as to allow access to the various spaces of the furniture 6.

According to one embodiment, as observable in FIGS. 5, 6, 7 and 10, said at least two closing elements 2 are suitable for being received by a respective mechanism seat 18 received on the surface of the furniture 6 on which the closing mechanism 1 is suitable for being fixed.

According to one embodiment, such mechanism seat 18 may be obtained on a surface of the dividing panel 16 of the furniture 6 for example on the upper or lower part of such panel so that the closing mechanism 1 is suitable for being arranged in a position proximal to the peripheral part of the furniture 6 so as to allow placing the locking body 3 with a portion thereof which can be used from outside of the furniture 6.

According to one embodiment, the closing element 2 comprises a movement seat arranged in proximity of the pins 8 and the pin seat 17 which allows the movement of such closing element 2 with respect to the locking body 3. In other words such seat allows preventing the geometric interference with other components of the closing mechanism during the rotation about the rotation axis R-R of the closing element 2.

Furthermore, this allows further reducing the overall dimensions of the closing mechanism in that the various components of the mechanism can be neared without precluding the operation thereof.

According to one embodiment, such movement seat is obtained as a lowering of the thickness of the closing element 2.

The closing mechanism 1 further comprises the previously introduced locking body 3 suitable for being positioned with the portion for inserting the key outside the furniture 6, so that a user can open or close the furniture 6 by using such locking body 3.

According to one embodiment, the locking body 3 is suitable for being fixedly connected to the furniture and comprises a rotation pin 10 arranged on one end of the locking body 3 facing any one of said at least two closing elements 2, where such rotation pin 10 mechanically cooperates with the pins 8 of any one of said at least two closing elements 2 so as to transmit the rotation to such closing element 2.

According to one embodiment, such locking body 3 comprises a key insertion portion 19 suitable to be faced outside the furniture 6 and aimed at receiving a key to allow the use of such locking body 3.

Furthermore, such locking body 3 comprises said rotation pin 10 that is received by the respective pins 8 of the closing element 2 and mechanically cooperates therewith so as to allow the rotation of any one of said at least two closing elements 2.

According to one embodiment, the locking body 3 is of the known type controlled by a key which allows the rotation of a locking cylinder 22. To such locking cylinder 22 there is connected the rotation pin 10, so that the rotation axis of the locking cylinder 22 is parallel to the axis about which there rotates the rotation pin 10 but not coincident with the latter. In other words, the rotation pin 10 is positioned along the periphery of the locking cylinder 22 so that the rotation of the cylinder 22 determines a circular movement of the rotation pin 10.

According to one embodiment, the axis S-S about which the rotation pin rotates is perpendicular to the rotation axis R-R of said at least one closing element 2.

The movement of the rotation pin 10 determines the rotation of the closing element 2 by a predefined amount so as to pass from the first closing position to the second closing position or vice-versa. Actually, the circular movement of the rotation pin about the axis S-S determines the circular movement of the pins 8 against which it ends in abutment, about the rotation axis R-R.

In particular, the locking body 3 guarantees the locking of any one of said at least two closing elements 2 in one of the two described positions: open or closed.

Should the user intend to modify the position of the closing elements 2 so as to pass from the first open position to the second closing position or vice-versa, it is required to insert the special key in the locking body 3 and rotate it by a predetermined amount so as to modify the aforementioned position and then remove the key locking the closing mechanism 1 in such position desiderata.

According to one embodiment, the locking body 3 is suitable for being received in a locking seat 20 of the furniture 6 that is suitable for partly receiving also part of the closing element 2 in particular the pins 8 thereof.

The closing mechanism 1 further comprises the synchronization bar 7 which fixedly connects—to the rotation—all the closing elements 2 used so that the rotation of any one of said at least two closing elements 2 connected to the locking body 3 imparts the rotation of the remaining closing elements 2.

According to one embodiment, the synchronization bar 7 comprises hooking holes 11 arranged along the extension thereof so as to receive the respective hooking means 9 of each closing element 2. Thus, the movement of the hooking means 9 are integral to each other given that they are connected by a rigid body which in the latter case is the synchronization bar 7.

According to one embodiment, the synchronization bar 7 is arranged perpendicularly with respect to the rotation axis R-R of said at least two closing elements 2 and it is also parallel to the rotation axis S-S of the rotation pin 10 of the locking body 3. The synchronization bar may move rigidly along such direction when forced to such movement by the rotation of any one of the closing elements 2.

According to one embodiment, the hooking holes 11 of the synchronization bar 7 are slot-shaped so as to receive the hooking pin 9 of said at least one closing element 2 leaving a clearance in the coupling. Such coupling is necessary to allow the transformation of the circular motion of the hooking pin 9 about the rotation axis R-R in the translation of the synchronization bar 7 in the direction perpendicular to such axis. Actually the hooking pin 9 moves along an arc-circle with respect to the bar 7 which it translates. In other words the hooking pin 9 of any one of the closing elements 2 serves as a hand grip with respect to the bar 7. It will thus be necessary to leave a clearance between the hooking pin 9 and the hooking hole 11 in the direction perpendicular to the direction of translation of the synchronization bar 7.

According to one embodiment, the synchronization bar 7 is suitable to be received by a bar seat 21 obtained in the furniture 6 in which it is suitable for sliding when moved by said at least two closing elements 2.

According to one embodiment, the dividing panel of the furniture 16 comprises a bar seat 21 that receives the synchronization bar 7 and allows it to translate.

According to one embodiment, all the closing elements 2 are arranged spaced from each other along a predetermined direction and suitable for being fixed to the furniture 6 in a position such that each closing element 2 is associated to a respective sliding door 5 and in which such closing elements 2 rotate as a unit due to the synchronization bar 7 connected to them through the hooking means 9.

Figure 5:
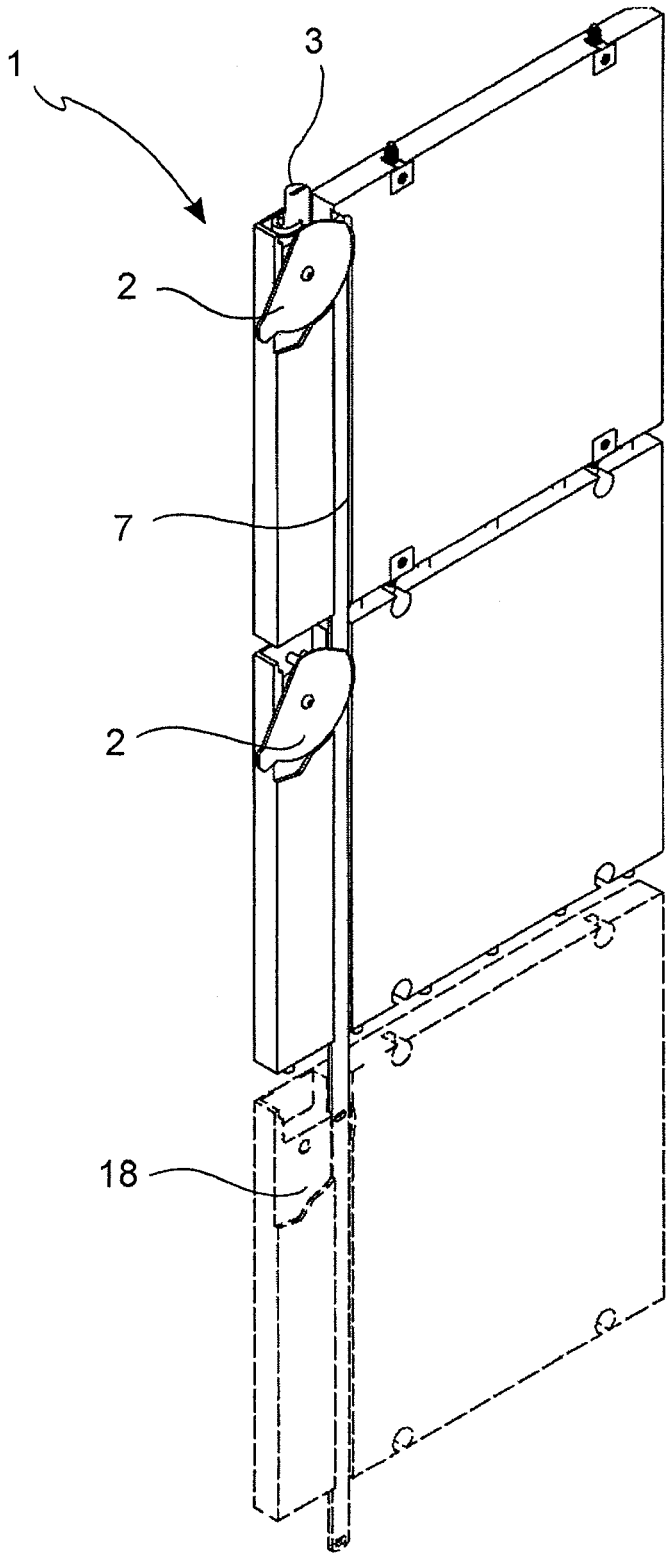
FIG. 5 illustrates an axonometric view of a portion of the furniture with sliding doors comprising the closing mechanism according to the invention.
Figure 6:
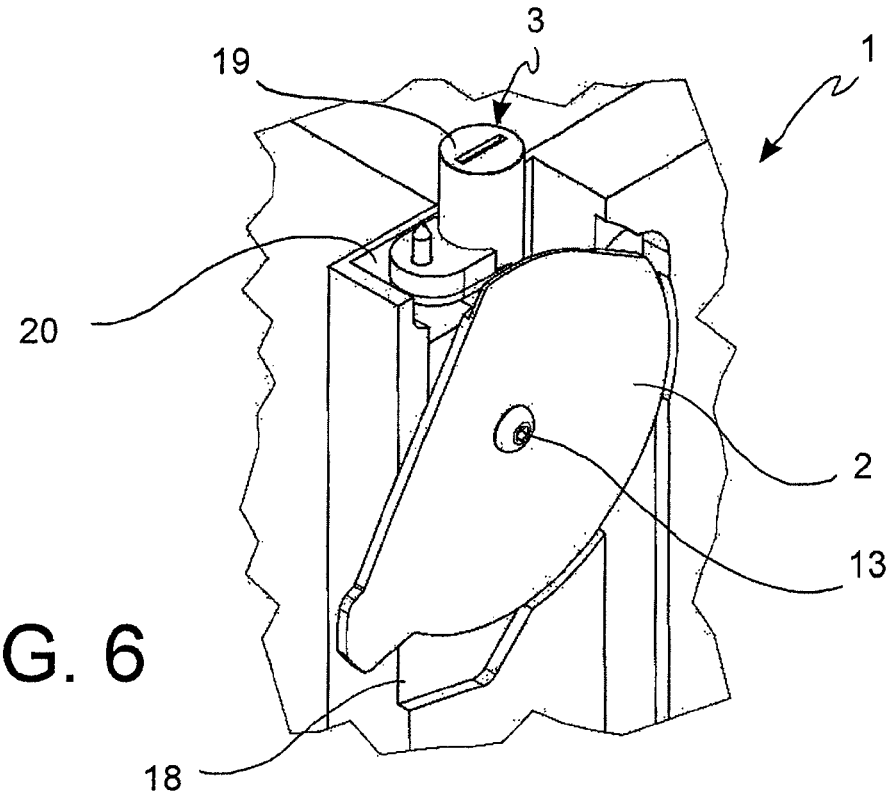
FIG. 6 illustrates an enlarged portion of FIG. 5.
Figure 7:
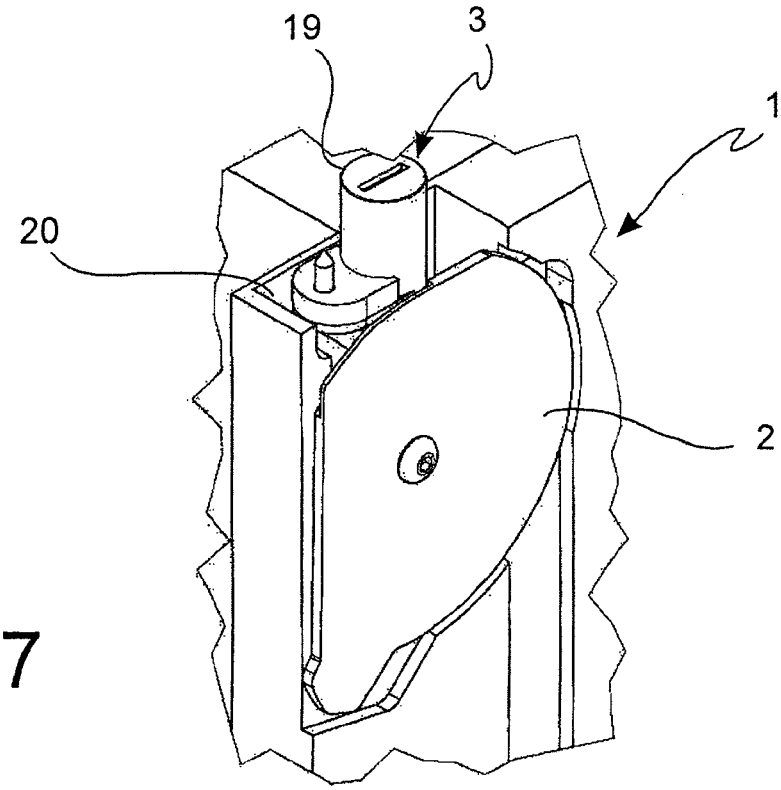
FIG. 7 illustrates the same view of FIG. 6 but with the closing mechanism in open position.
Figure 8:
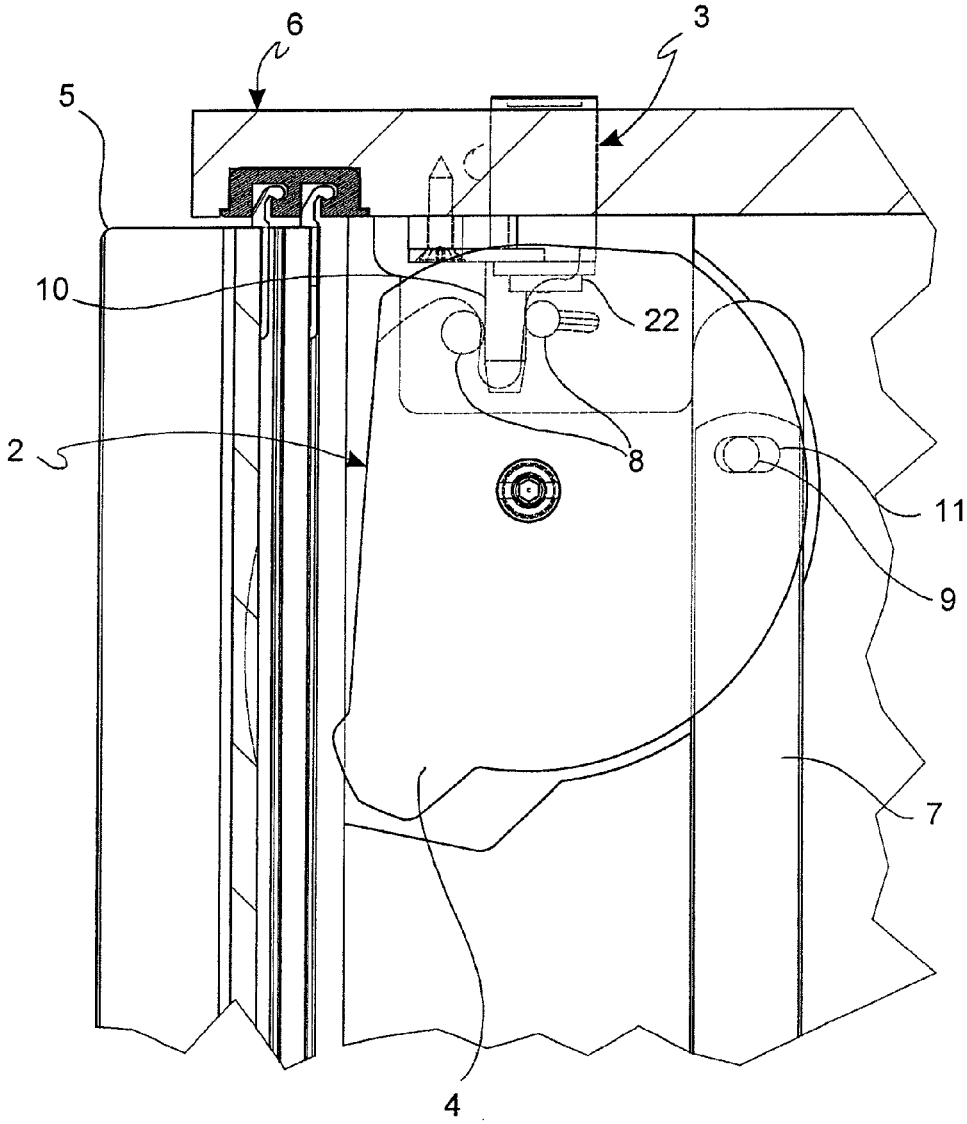
FIG. 8 illustrates a view in orthogonal projection of a part of the closing mechanism according to the invention in open position.
Figure 9:
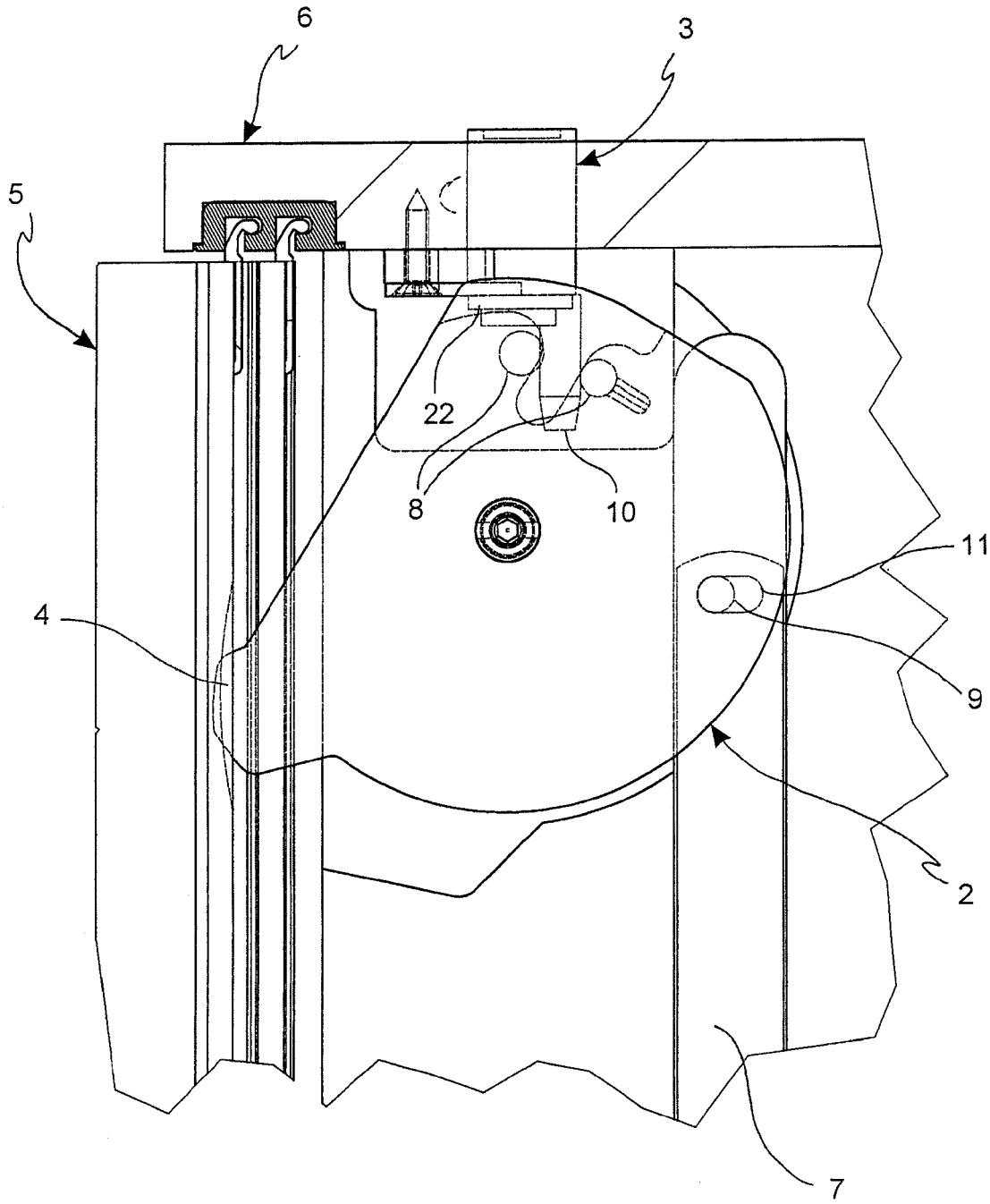
FIG. 9 illustrates the same view of FIG. 8 but with the closing mechanism in closing position.
Figure 10:
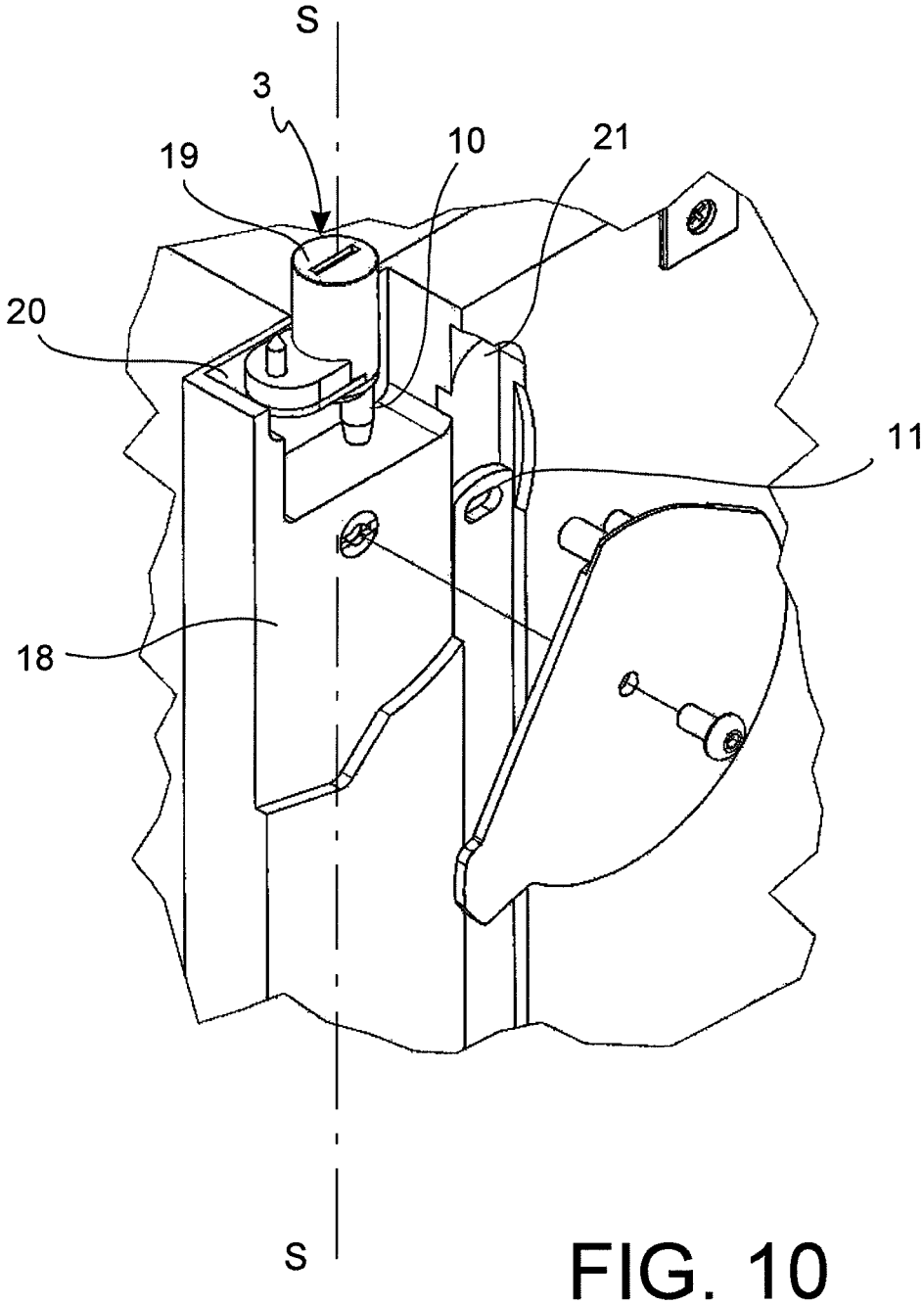
FIG. 10 illustrates the closing mechanism with parts of FIG. 6 separated.

As observable in FIGS. 1 and 5, the closing elements 2 may be arranged spaced from each other along a direction perpendicular to the rotation axis R-R.

According to one embodiment, each closing element 2 is suitable to lock—in closing position—a pair of sliding doors 5 of the furniture 6.

Advantageously the closing mechanism allows attaining a robust and reliable closure of the sliding doors simultaneously preventing the mechanism from damaging the doors even in the case where the latter are made of fragile material, for example glass.

Advantageously, due to the disc-shaped configuration of said at least two closing elements 2 the closing mechanism 1 has a small overall dimension which can be further reduced by inserting the various components of the mechanism in the thickness of the panels forming the structure of the furniture 6.

According to one embodiment, said at least two closing elements 2 are fixedly connected to a dividing panel of the furniture 16 that is arranged inside the furniture 6 and is suitable for dividing at least one space in the furniture 6 into sub-spaces.

Will now be described the operation of the closing mechanism 1 according to the invention when installed on a furniture with sliding doors. The user intending to prevent access to the space or spaces of the furniture with sliding doors activates the closing mechanism by using a key which allows the rotation of the locking cylinder 22 of the locking body 3.

Thus with the sliding doors 5 of the furniture 6 in closing position, the rotation pin 10 of the locking body 3 integral with the locking cylinder 22 is rotated and thus mechanically cooperates with the pins 8 of any one of the closing elements 2. Actually, the rotation pin 10 is received between the pins 8 of any one of the closing elements 2 and ends up in abutment therewith when rotated so that the pins 8 are drawn by the movement of the rotation pin 10 rotating—along the rotation axis R-R—the closing element 2 by a predefined arc-portion so as to pass from the first to the second position as defined previously or vice-versa.

Such rotation of the closing element 2, allows ensuring that the locking portion 4 of such closing element 2 engages the relative sliding doors 5 of one of the spaces of the furniture so that such doors are locked in closing position and they cannot be made to slide along the direction of translation T-T.

Simultaneously with the rotation of one of the closing elements 2 directly connected to the locking body 3, the synchronization bar 7 allows rotating the remaining closing elements 2 arranged so as to ensure the closure of the sliding doors arranged to protect the remaining spaces of the furniture.

For example, the furniture 6 may be formed by one or more spaces superimposed with respect to each other and divided by a shelf 15 and which may be closed by means of the sliding doors 5 that may translate along directions parallel to the direction of translation T-T.

As mentioned, to the rotation of the closing element 2 connected to the locking body 2 there corresponds the rotation of all the remaining closing elements 2 due to the intervention of the synchronization bar 7 that is integral with the closing elements 2 due to the hooking means 9 arranged along the peripheral of the latter 2 which allow transforming the rotation of the closing element 2 in the translation of the synchronization bar 7 which, being in turn connected with the remaining closing elements 2, due to the translation, allows the rotation of such elements.

Thus each sliding door 5 used for closing a space in the furniture 5 is locked in closing position.

Though in the figures used alongside the description there is represented a furniture with only two spaces and two pairs of sliding doors, any other configuration of spaces and sliding doors may be used suitably varying the number of the closing elements 2 so that they match the number of sliding doors to be controlled, as shown in FIG. 5.

The operation of the mechanism 1 described above refers to the closing steps but analogously it may entirely indicate the closing mechanism 1 in open position so as to allow the normal translation of the sliding doors so as to be able to access the inner spaces of the furniture. The only variation between the closing and opening steps actually regards only the initial direction of rotation of the key in the locking body 3.

The embodiments of the device described above may be subjected—by a man skilled in the art to meet contingent needs—to modifications, adaptations and replacement of elements with other functionally equivalent elements, without departing from the scope of protection of the following claims. Each of the features described, as belonging to a possible embodiment, may be obtained independently from the other described embodiments.

What is claimed is:

1. Furniture comprising:

a furniture structure having at least one interior space, a front, a left side, and a right side, the front being located between the left side and the right side;

at least two sliding doors configured to slide along a translation direction, and wherein the translation direction is from the left side to the right side, to provide access to the interior space, and wherein a first one of the sliding doors is horizontally slidable in the translation direction within a sliding plane, and wherein the first one of the slidable doors has a vertical side edge that is located within the sliding plane, and wherein a second one of the sliding doors is horizontally slidable in the translation direction within the sliding plane, and wherein the second one of the sliding doors is located beneath the first one of the sliding doors, such that the first one of the sliding doors is located above the second one of the sliding doors; and a closing mechanism for simultaneously locking the sliding doors in closed positions, and for permitting sliding movement of the sliding doors to open positions; and wherein the closing mechanism includes:

at least two closing elements, each associated to a respective one of the first and second ones of the sliding doors, such that a first one of the closing elements is associated with the first one of the sliding doors, and the second one of the closing elements is associated with the second one of the sliding doors, the first one of the closing elements being located above the second one of the closing elements, and wherein each of the first and second ones of the closing elements is fixedly connected to the furniture structure and with respect to the furniture structure rotatable about a rotation axis; and a locking body fixedly connected to the furniture structure, said locking body being associated to the first one of the closing elements so as to make the first one of the closing elements rotate by a predetermined amount about a rotation axis from a first to a second angular position and vice-versa and so as to be able to lock the first one of the closing elements in any one of said angular positions; and said first one of the closing elements including a locking portion that through the rotation of the first one of the closing elements, can pass from a first position in which such locking portion is suitable for preventing the translation of the first one of the sliding doors of the furniture to a second position suitable for allowing the translation of the first one of the sliding doors;

wherein the first one of the sliding doors and the closing mechanism are configured such that the locking portion of the first one of the closing elements is located within the sliding plane, and engages the vertical side edge of the first one of the sliding doors to prevent sliding of the first one of the sliding doors, when the first one of the closing elements is in the first position, and the locking portion of the first one of the closing elements is not located within the sliding plane, and does not engage the vertical side edge of the first one of the sliding doors, and thereby permits sliding of the first one of the sliding doors, when the first one of the closing elements is in the second position, and wherein the axis of rotation of the first one of the closing elements is parallel to the sliding plane;

wherein the closing mechanism includes a vertically-aligned synchronization bar that makes said at least two closing elements rotate as a unit so that the rotation through the locking body of any one of said closing elements determines the simultaneous rotation of all the other closing elements connected through the synchronization bar ensuring the simultaneous locking in said first closing position or in said second open position of the first and the second sliding doors of the furniture;

wherein the second one of the sliding doors has a vertical side edge, and the second one of the closing elements engages the vertical side edge of the second one of the sliding doors to prevent sliding of the second one of the sliding doors, and wherein the at least two sliding doors includes a third sliding door that is horizontally slidable in the translation direction to be located behind the first one of the sliding doors, and wherein the third door is located between the interior space and the first one of the sliding doors when the third door is located behind the first one of the sliding doors, and wherein the first one of the sliding doors is located between (1) the front of the furniture structure and (2) the third door when the third door is located behind the first one of the sliding doors;

wherein the synchronization bar is located within the interior space of the furniture structure; and wherein each of said at least two closing elements includes a hooking pin that projects from a surface of said elements so as to fixedly connect said elements to the synchronization bar.

2. Furniture comprising:

a furniture structure having at least one interior space, a front, a left side, and a right side, the front being located between the left side and the right side;

at least two sliding doors configured to slide along a translation direction, and wherein the translation direction is from the left side to the right side, to provide access to the interior space, and wherein a first one of the sliding doors is horizontally slidable in the translation direction within a sliding plane, and wherein the first one of the slidable doors has a vertical side edge that is located within the sliding plane, and wherein a second one of the sliding doors is horizontally slidable in the translation direction within the sliding plane, and wherein the second one of the sliding doors is located beneath the first one of the sliding doors, such that the first one of the sliding doors is located above the second one of the sliding doors; and a closing mechanism for simultaneously locking the sliding doors in closed positions, and for permitting sliding movement of the sliding doors to open positions; and wherein the closing mechanism includes:

at least two closing elements, each associated to a respective one of the first and second ones of the sliding doors, such that a first one of the closing elements is associated with the first one of the sliding doors, and the second one of the closing elements is associated with the second one of the sliding doors, the first one of the closing elements being located above the second one of the closing elements, and wherein each of the first and second ones of the closing elements is fixedly connected to the furniture structure and with respect to the furniture structure rotatable about a rotation axis; and a locking body fixedly connected to the furniture structure, said locking body being associated to the first one of the closing elements so as to make the first one of the closing elements rotate by a predetermined amount about a rotation axis from a first to a second angular position and vice-versa and so as to be able to lock the first one of the closing elements in any one of said angular positions; and said first one of the closing elements including a locking portion that through the rotation of the first one of the closing elements, can pass from a first position in which such locking portion is suitable for preventing the translation of the first one of the sliding doors of the furniture to a second position suitable for allowing the translation of the first one of the sliding doors;

wherein the first one of the sliding doors and the closing mechanism are configured such that the locking portion of the first one of the closing elements is located within the sliding plane, and engages the vertical side edge of the first one of the sliding doors to prevent sliding of the first one of the sliding doors, when the first one of the closing elements is in the first position, and the locking portion of the first one of the closing elements is not located within the sliding plane, and does not engage the vertical side edge of the first one of the sliding doors, and thereby permits sliding of the first one of the sliding doors, when the first one of the closing elements is in the second position, and wherein the axis of rotation of the first one of the closing elements is parallel to the sliding plane;

wherein the closing mechanism includes a vertically-aligned synchronization bar that makes said at least two closing elements rotate as a unit so that the rotation through the locking body of any one of said closing elements determines the simultaneous rotation of all the other closing elements connected through the synchronization bar ensuring the simultaneous locking in said first closing position or in said second open position of the first and the second sliding doors of the furniture;

wherein the second one of the sliding doors has a vertical side edge, and the second one of the closing elements engages the vertical side edge of the second one of the sliding doors to prevent sliding of the second one of the sliding doors, and wherein the at least two sliding doors includes a third sliding door that is horizontally slidable in the translation direction to be located behind the first one of the sliding doors, and wherein the third door is located between the interior space and the first one of the sliding doors when the third door is located behind the first one of the sliding doors, and wherein the first one of the sliding doors is located between (1) the front of the furniture structure and (2) the third door when the third door is located behind the first one of the sliding doors;

wherein the synchronization bar is located within the interior space of the furniture structure;

wherein the furniture structure includes an interior dividing panel, and wherein said at least two closing elements are fixedly connected to the dividing panel, and wherein the dividing panel is suitable for dividing at least one space in the furniture structure into sub-spaces; and wherein the dividing panel of the furniture includes a bar seat that receives the synchronization bar and allows the synchronization bar to translate.

* * * * *